US008159431B2

(12) United States Patent
Fujita et al.

(10) Patent No.: US 8,159,431 B2
(45) Date of Patent: Apr. 17, 2012

(54) ELECTROOPTIC DEVICE AND ELECTRONIC APPARATUS

(75) Inventors: Shin Fujita, Suwa (JP); Makoto Hayashi, Gifu (JP); Hideki Kawada, Owariasahi (JP)

(73) Assignee: Sony Corporation, Tokyo (JP)

( * ) Notice: Subject to any disclaimer, the term of this patent is extended or adjusted under 35 U.S.C. 154(b) by 928 days.

(21) Appl. No.: 12/183,600

(22) Filed: Jul. 31, 2008

(65) Prior Publication Data

US 2009/0091523 A1 Apr. 9, 2009

(30) Foreign Application Priority Data

Oct. 4, 2007 (JP) ..... 2007-260619

(51) Int. Cl.
*G09G 3/36* (2006.01)

(52) U.S. Cl. ..... 345/87; 345/98; 345/100

(58) Field of Classification Search ..... 345/87, 345/98, 100

See application file for complete search history.

(56) References Cited

U.S. PATENT DOCUMENTS

| | | | | |
|---|---|---|---|---|
| 6,040,814 | A * | 3/2000 | Murakami et al. | 345/94 |
| 6,262,702 | B1 * | 7/2001 | Murade | 345/87 |
| 6,300,926 | B1 * | 10/2001 | Yoneya et al. | 345/87 |
| 6,580,486 | B1 * | 6/2003 | Sekine | 349/139 |
| 6,611,261 | B1 * | 8/2003 | Zhang et al. | 345/204 |
| 6,703,994 | B2 * | 3/2004 | Edwards | 345/87 |
| 6,829,392 | B2 * | 12/2004 | Aoki | 382/275 |
| 6,831,622 | B2 * | 12/2004 | Aoki | 345/87 |
| 7,626,567 | B2 * | 12/2009 | Aoki | 345/87 |
| 2001/0015709 | A1 * | 8/2001 | Imajo et al. | 345/87 |
| 2003/0011696 | A1 * | 1/2003 | Yamazaki | 348/312 |
| 2003/0151713 | A1 * | 8/2003 | Aoki | 349/149 |
| 2005/0099374 | A1 * | 5/2005 | Sagawa | 345/87 |
| 2005/0206597 | A1 * | 9/2005 | Ishii | 345/87 |
| 2007/0171162 | A1 * | 7/2007 | Mochizuki | 345/87 |

FOREIGN PATENT DOCUMENTS

| | | |
|---|---|---|
| JP | A-2000-171829 | 6/2000 |
| JP | A-2005-249940 | 9/2005 |
| JP | A-2007-156473 | 6/2007 |

* cited by examiner

*Primary Examiner* — Amare Mengistu
*Assistant Examiner* — Aaron M Guertin
(74) *Attorney, Agent, or Firm* — K&L Gates LLP

(57) ABSTRACT

An electrooptic device including a plurality of scanning lines; a plurality of m image signal lines; m connecting signal lines provided in a one-to-one correspondence with the m image signal lines; a plurality of data lines blocked by m lines, m data lines in one block being provided in a one-to-one correspondence with the m image signal lines; a scanning-line driving circuit; a block selecting circuit; a sampling switch provided for each of the plurality of data lines; and pixels provided at the intersections of the plurality of scanning lines and the plurality of data lines. Each pixel becomes a gray level corresponding to the data signal sampled to the data line when the scanning line is selected.

6 Claims, 12 Drawing Sheets

ELECTROOPTIC DEVICE AND ELECTRONIC APPARATUS

BACKGROUND

1. Technical Field

The present invention relates to a technique for reducing an area necessary for wiring in a configuration in which data signals sent to image signal lines are sampled to data lines.

2. Related Art

Electrooptic devices such as liquid crystal displays are configured such that pixels are provided at the intersections of scanning lines and data lines, and pixels on a selected scanning line are lit at the luminosity (gray level) corresponding to the voltage of data signals supplied to the data lines. This configuration is divided roughly into a digital drive system and an analog drive system in terms of the system of driving, of which the analog drive system is widely used at present.

In such an analog drive system, a demultiplexer system and a block sequence system are frequently used. Between them, the block sequence system is a system in which data lines are divided into blocks by a predetermined number of columns, for example, six columns, and the blocks are selected in sequence during a period in which one scanning line is selected so that data signals fed to six image signal lines are sampled to six columns of data lines in a selected block at the same time (refer to JP-A-2007-156473).

This block sequence system, however, has a problem in routing a plurality of image signal lines. More specifically, this system needs a wide space for routing the image signal lines depending on the position of connecting terminals, which is a leading cause of hindering decreasing the area outside the display area, that is, a frame area.

SUMMARY

An advantage of some aspects of the invention is that an electrooptic device and an electronic apparatus are provided in which the frame area in the block sequence system is decreased.

According to a first aspect of the invention, there is provided an electrooptic device including: a plurality of scanning lines; a plurality of m image signal lines; m connecting signal lines provided in a one-to-one correspondence with the m image signal lines, each connecting signal line being connected to the corresponding image signal line to feed a data signal; a plurality of data lines blocked by m lines, m data lines in one block being provided in a one-to-one correspondence with the m image signal lines; a scanning-line driving circuit that selects the plurality of scanning lines in a predetermined order; a block selecting circuit that outputs sampling signals indicative of the selection of the blocks in a predetermined order during a period selected for one scanning line; a sampling switch provided for each of the plurality of data lines, each sampling switch being turned on between the corresponding image signal line and data line when the sampling signal selects a block; and pixels provided at the intersections of the plurality of scanning lines and the plurality of data lines, each pixel becoming a gray level corresponding to the data signal sampled to the data line when the scanning line is selected. The block selecting circuit has a plurality of unit circuits whose output terminals are each connected to the input terminal of the following stage, the unit circuits each outputting a pulse provided to the input terminal from the output terminal with a predetermined delay and outputting a sampling signal according to the pulse provided to the input terminal and the output terminal. The connecting signal lines intersect an interconnect signal line connecting the output terminal of one unit circuit and the input terminal of the unit circuit in the following stage. With this configuration, there is no need to route the m image signal lines around the block selecting circuit by using the m interconnect signal lines. This eliminates the need for corresponding space, allowing the frame to be narrowed.

It is preferable that the m image signal lines be provided in the direction intersecting the extensions of the plurality of data lines; and the direction of the arrangement of the unit circuits agree with the direction in which the m image signal lines are provided. The m connecting signal lines may intersect one interconnect signal line.

It is preferable that the pixels be in one of n colors (n is an integer greater than or equal to 3); the m be a multiple of n; m data lines in one block be arranged such that data lines corresponding to pixels of the n colors are arranged repeatedly in a predetermined order; the m image signal lines be arranged repeatedly in the same order as the colors of the m data lines; and m/n connecting signal lines connected to image signal lines corresponding to one color intersect at least one interconnect signal line. This configuration allows the time constants of the connecting signal lines to be set by color.

It is preferable that the pixels be in one of n colors (n is an integer greater than or equal to 3); the m be a multiple of n; m data lines in one block be arranged such that data lines corresponding to pixels of the n colors are arranged repeatedly in a predetermined order; the m image signal lines be arranged in the group of m/n lines in the same order as the colors of the m data lines; and m/n connecting signal lines connected to image signal lines corresponding to one color intersect one interconnect signal line. This configuration allows not only the time constants of the connecting signal lines but also the time constants of the image signal lines to be set by color.

According to a second aspect of the invention, there is provided an electronic apparatus including the electrooptic device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described hereinbelow with reference to the drawings.

Figure 1:
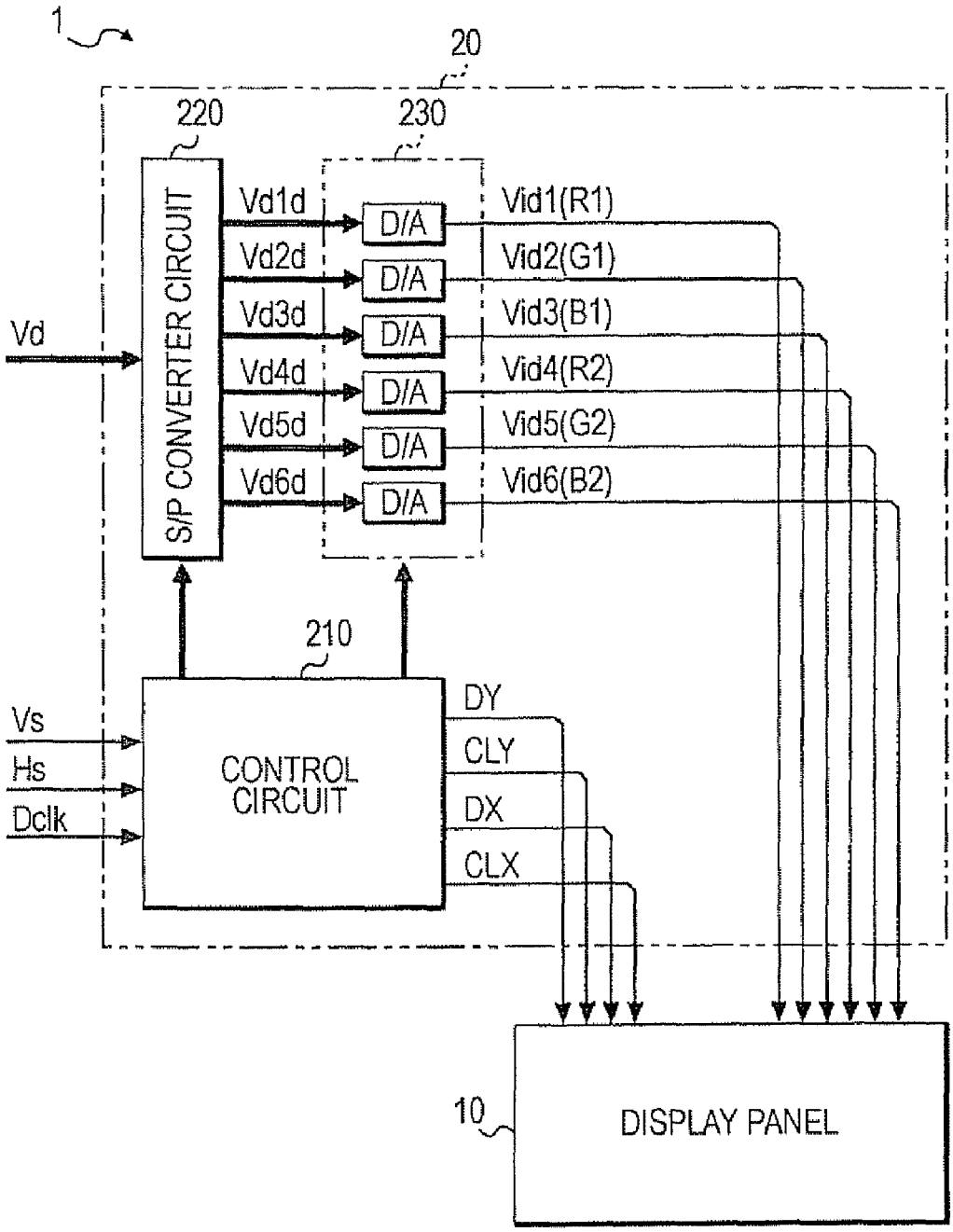
FIG. 1 is a block diagram of an electrooptic device according to a first embodiment of the invention.

FIG. 1 is a block diagram showing the overall configuration of an electrooptic device according to a first embodiment of the invention. As shown in FIG. 1, the electrooptic device 1 is roughly divided into a display panel 10 and a processing circuit 20. The processing circuit 20 is a circuit module connected to the display panel 10 by, for example, a flexible printed circuit (FPC) board.

The processing circuit 20 includes a control circuit 210, an S/P converter circuit 220, and a D/A converter circuit group 230. Among them, the control circuit 210 controls the operation of the S/P converter circuit 220 in synchronism with a vertical synchronizing signal Vs, a horizontal synchronizing signal Hs, and a dot clock signal Dclk sent from an external upper-level circuit (not shown), designates the polarity to be converted by the a D/A converter circuit group 230, and outputs start pulses DX and DY and clock signals CLX and CLY for controlling the operation of the display panel 10. Although not shown in FIG. 1, the control circuit 210 also outputs an inverted clock signal CLXinv that is inverted in logic from the clock signal CLX and an inverted clock signal CLYinv that is inverted in logic from the clock signal CLY to the display panel 10.

The S/P converter circuit 220 distributes digital image data Vd, which is sent in synchronism with the vertical synchronizing signal Vs, the horizontal synchronizing signal Hs, and the dot clock signal Dclk, to six channels such that data of one dot is extended to twice along a time axis (also referred to as serial-parallel conversion or phase expansion), and outputs them as image data Vd1*d* to Vd6*d*, as will be described later.

The image data Vd designates, for one dot, the gray levels (luminances) of color components, red (R), green (G), and blue (B), respectively. The S/P converter circuit 220 distributes, of the dots designated by the image data Vd, those that designate the gray levels of R, G, and B of the dots in the odd-numbered columns as image data Vd1*d*, Vd2*d*, and Vd3*d*, respectively, and those that designate the gray levels of R, G, and B of the dots in the even-numbered columns following the odd-column dots as image data Vd4*d*, Vd5*d*, and Vd6*d*, respectively.

The D/A converter circuit group 230 is a group of D/A converter circuits each provided for each channel. The D/A converter circuit group 230 converts the voltages of the image data Vd1*d* to Vd6*d* to voltages with polarities designated by the control circuit 210, respectively, and outputs them as data signals Vid1 to Vid6.

Figure 8:
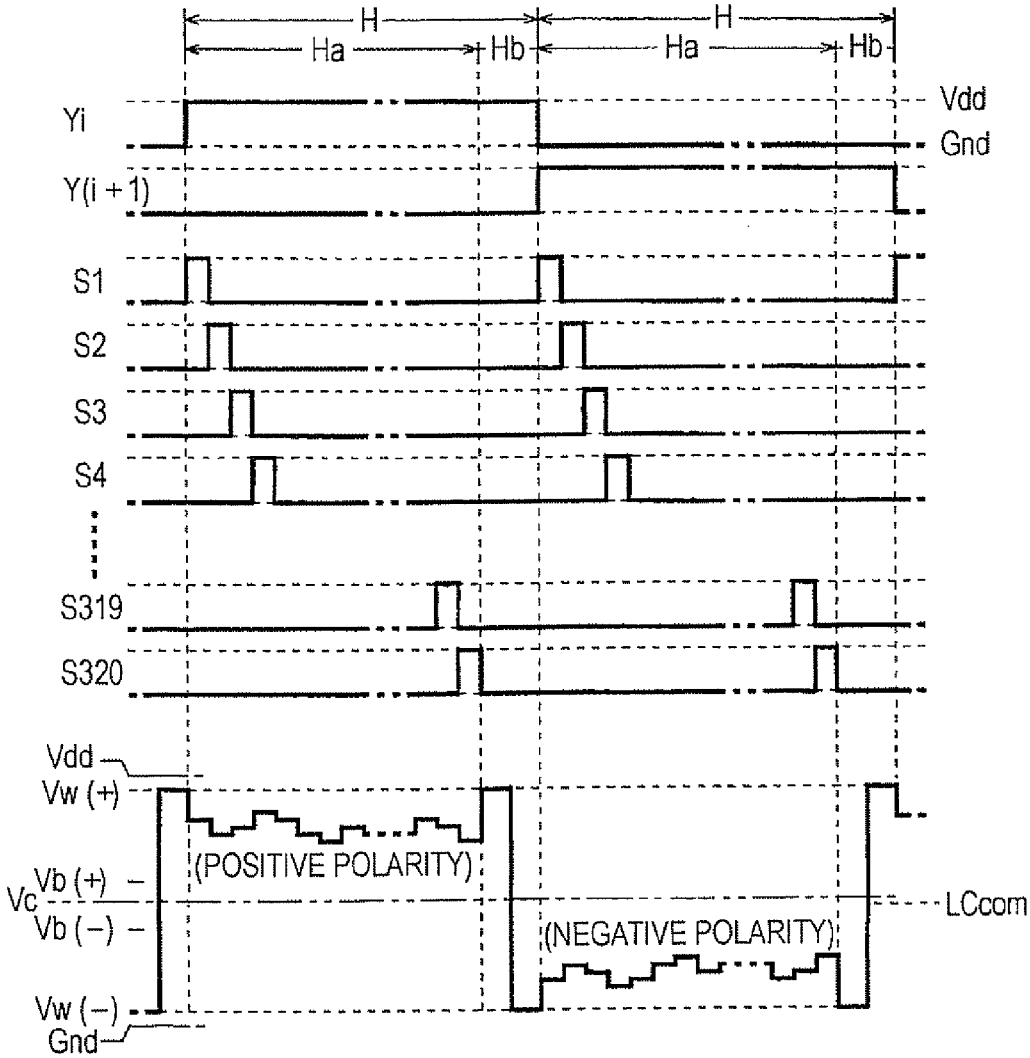
FIG. 8 is a diagram showing an example of the voltage waveform of a data signal of the electrooptic device.

Assume that the polarities of the data signals Vid1 to vid6 are positive at the higher level relative to a voltage Vc and negative at the lower side. As shown in FIG. 8 later, the voltage Vc is almost in the center between a selected voltage Vdd corresponding to a high level and a potential Gnd (zero in voltage) corresponding to a low level and the reference of voltage.

The data signals Vid1, Vid2, and Vid3 are denoted as R1, G1, and B1, since they are signals with voltages corresponding to the gray levels of R, G, and B of the odd-column dots, Likewise, data signals Vid4, Vid5, and Vid6 are denoted as R2, G2, and B2, since they are signals with voltages corresponding to the gray levels of R, G, and B of the even-column dots.

Figure 2:
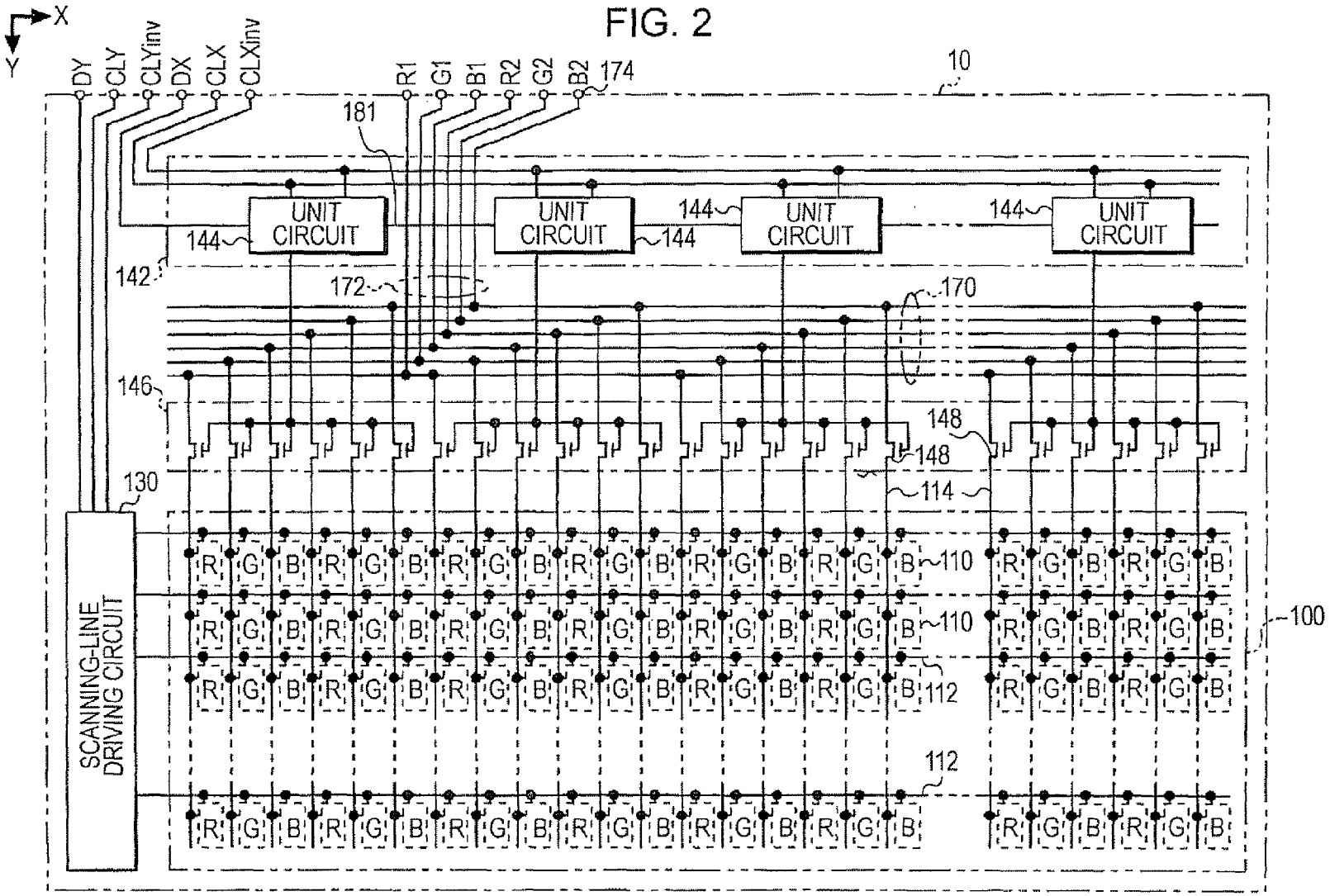
FIG. 2 is a schematic plan view of a display panel of the electrooptic device.

The configuration of the display panel 10 will next be described. FIG. 2 is a plan view of the display panel 10.

The display panel 10 displays an image using liquid crystal, and is of a peripheral circuit built-in type having a scanning-line driving circuit 130, a block selecting circuit 142, image signal lines 170, and a sampling circuit 146 around a display area 100.

The display area 100 has an array of pixels 110. In this embodiment, 480 scanning lines 112 are provided in the horizontal direction (in the X-direction), and 1,920(=640×3) data lines 114 in the vertical direction (in the Y-direction). The pixels 110 are provided in the intersections of the scanning lines 112 and the data lines 114.

The pixels 110 are arrayed in correspondence with R, G, and B column by column. The three pixels R, G, and B adjacent in the X-direction represent 1-dot color. Accordingly, in this embodiment, the pixels 110, the unit of display, are arrayed in a 480- by 1,920-pixel matrix in the display area 100, while the dots, the unit of color display, are arrayed in a 480- by 680 matrix. However, the invention is not limited to those arrays.

The one to 1,920 data lines 114 are divided into blocks by adjacent six columns. Since the number of columns of the data lines 114 is 1,920, the number of blocks is 320.

Next, the pixels 110 will be described.

Figure 3:
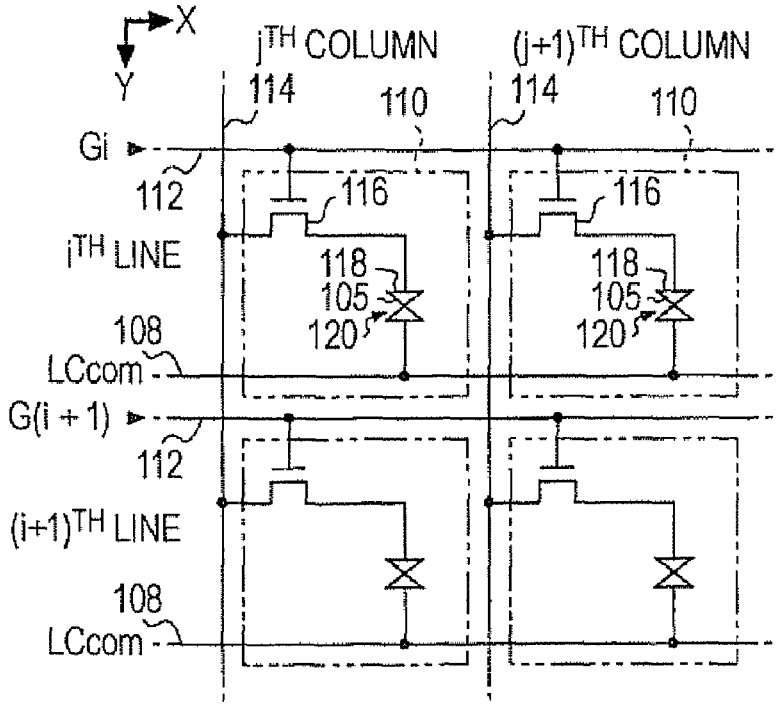
FIG. 3 is a diagram showing the structure of the pixels of the display panel.

FIG. 3 is a diagram of the structure of the pixels 110, showing 2×2 pixels, four pixels in total, corresponding to the intersections of the $i^{th}$ and $(i+1)^{th}$ lines adjacent to that below and the $j^{th}$ and $(j+1)^{th}$ columns adjacent to that on the right. The symbols i and (i+1) indicate the lines, in a general way, in which the pixels 110 are arrayed and, in this embodiment, which are each an integer ranging from 1 to 480. The symbols j and (j+1) indicate the columns, in a general way, in which the pixels 110 are arrayed and, in this embodiment, which are each an integer ranging from 1 to 1,920.

As shown in FIG. 3, the pixels 110 each include an n-channel thin-film transistor (hereinafter, abbreviated to a TFT) 116 and a liquid crystal element 120. Since the pixels 110 of this embodiment have the electrically same structure, a pixel in the $i^{th}$ line and $j^{th}$ column will described as a typical example. The gate electrode of the TFT 116 of the pixel in the $i^{th}$ line and $j^{th}$ column is connected to the $i^{th}$ scanning line 112, while its source electrode is connected to the $j^{th}$ data line 114 and its drain electrode is connected to a pixel electrode 118.

Although not particularly shown, the display panel 10 is constructed such that a pair of a device substrate and a counter substrate is boned together with a space therebetween, between which liquid crystal 105 is sealed-in. On the device substrate are the scanning lines 112, the data lines 114, the TFTs 116, and pixel electrodes 118. On the counter substrate are common electrodes 108. The device substrate and the counter substrate are bonded together such that the electrode formed surfaces are opposed with a space therebetween. Thus, in this embodiment, the liquid crystal element 120 is formed by the pixel electrode 118 and the common electrode 108 sandwiching the liquid crystal 105. In this embodiment, the common electrode 108 is given a temporally constant voltage LCcom.

This embodiment, if the liquid crystal element 120 is of a transmissive type, has a color filter (not shown) for coloring transmitted light. In this case, the liquid crystal element 120 is set in a normally block mode in which the transmittance of light passing between the pixel electrode 118 and the common electrode 108 becomes the minimum (the darkest state)

when the effective voltage held in the liquid crystal element 120 is zero, and increases gradually as the effective voltage increases. Therefore, the light emitted from a backlight unit (not shown) is colored in each pixel by the color filter according to the effective voltage held in the liquid crystal element 120, and let out.

The device substrate has the scanning-line driving circuit 130 at a side along the Y-direction outside the display area 100, and has the block selecting circuit 142, the image signal lines 170, and the sampling circuit 146 at a side along the X-direction in that order toward the display area 100.

The scanning-line driving circuit 130 provides scanning signals Y1 to Y480 to the first to $480^{th}$ scanning lines 112, respectively, during an effective vertical scanning period Fa of a vertical scanning period F. Specifically, the scanning-line driving circuit 130 selects the scanning lines 112 in order of first to $480^{th}$ lines every horizontal scanning period H to bring the voltage of a scanning signal to be sent to the selected scanning line to a high-level selection voltage Vdd and bring the voltage of scanning signals to be sent to the other scanning lines to a low-level ground voltage Gnd.

Figure 5:
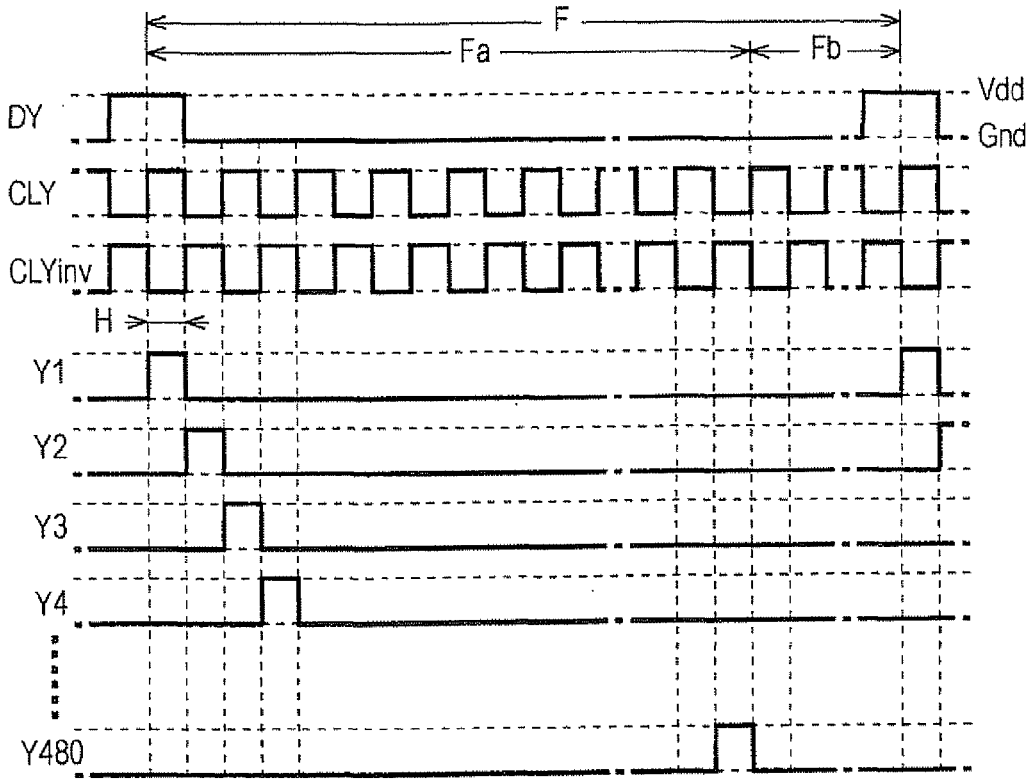
FIG. 5 is a timing chart showing the operation of the electrooptic device.

In FIG. 5, the period of the vertical scanning period F other than the effective vertical scanning period Fa is referred to as a vertical scanning retrace period Fb.

The block selecting circuit 142 is configured such that 320 unit circuits 144, corresponding to the total number of blocks of the data lines 114, are connected in series along the X-direction in which the scanning lines 112 extend. More specifically, the first unit circuit 144 from the left in FIG. 2 is provided with the start pulse DY, as an input signal, from the processing circuit 20 (the control circuit 210), and the signal output from the first unit circuit 144 is input to the second unit circuit 144 through a communicating signal line 181. Likewise, a signal output from one unit circuit 144 is transferred as an input signal to the following unit circuit 144.

Figure 4:
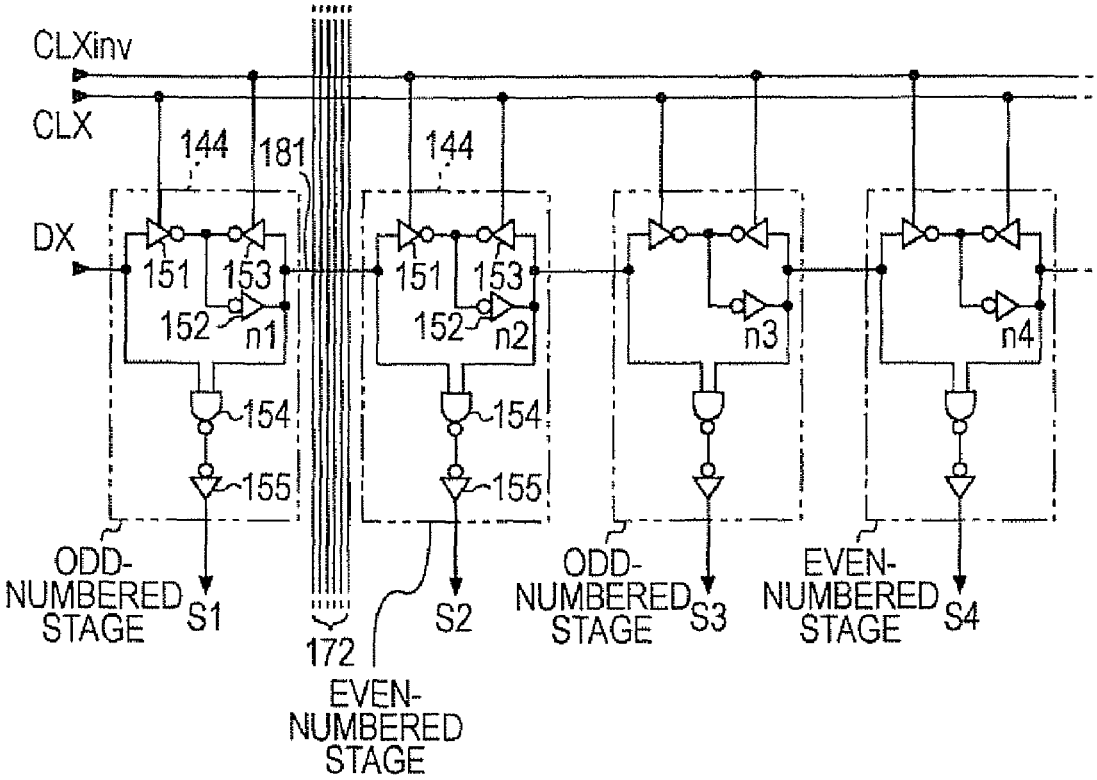
FIG. 4 is a diagram showing the structure of the unit circuits of the display panel.

The details of the unit circuits 144 will be described. FIG. 4 is a circuit diagram of the unit circuits 144.

The unit circuits 144 of both the odd- and even-numbered stages each have clocked inverters 151 and 153, inverters 152 and 155, and a NAND circuit 154. The input terminal of each of the unit circuits 144 is the input terminal of the clocked inverter 151. The output terminal of each unit circuit 144 is the output terminal of the inverter 152. For the sake pf convenience, the signals output from the output terminals of the unit circuits 144 of the first to 320th stages are denoted as n1 to n320, respectively.

The clocked inverters 151 in the unit circuits 144 of the odd-numbered stages each output an inverted signal that is inverted in logic from the signal input to its input terminal when the clock signal CLX is at a high level (when the inverted clock signal CLXinv is at a low level), and brings its output terminal into high impedance state when the clock signal CLX is at a low level (when the inverted clock signal CLXinv is at a high level), and its output terminal is connected to the input terminal of the inverter 152. The inverter 152 outputs the inverted signal of a signal input to its input terminal. The output terminal of the inverter 152 is connected to the input terminal of the clocked inverter 153. The clocked inverter 153 in each of the unit circuits 144 of the odd-numbered stages outputs a negative acknowledge signal that is inverted in logic from the signal input to its input terminal when the inverted clock signal CLXinv is at a high level (when the clock signal CLX is at a low level), and brings its output terminal into high impedance state when the inverted clock signal CLXinv is at a low level (when the clock signal CLX is at a high level), and its output terminal is connected to the input terminal of the inverter 152.

The NAND circuit 154 outputs a NAND signal of the signal input to the input terminal of the unit circuit 144 and the signal provided to the output terminal of the unit circuit 144. The inverter 155 reinverts the logic of the NAND signal and outputs it as a sampling signal. Accordingly, the sampling signal of one stage becomes the AND signal of the signal of the input terminal and the signal of the output terminal of the unit circuit 144 of the stage.

The unit circuits 144 in the even-numbered stages have the same configuration except that the function of the clocked inverters 151 and 153 are opposite to that of the odd-numbered stages. Specifically, the clocked inverters 151 in the even-numbered stages each output an inverted signal when the inverted clock signal CLXinv is at a high level, and brings its output terminal into high impedance state when the inverted clock signal CLXinv is at a low level, while the clocked inverters 153 in the even-numbered stages each output an inverted signal when the clock signal CLX is at a high level, and brings its output terminal into high impedance state when the clock signal CLX is at a low level but the others are the same as those of the odd-numbered stages.

With this configuration, the output terminal of the clocked inverters 153 in the unit circuits 144 of the even-numbered stages are brought into high impedance state when the clock signal CLX is at a high level (when the inverted clock signal CLXinv is at a low level). Accordingly, the signals input to the input terminals of the unit circuits 144 of the even-numbered stages are reversed to positive by two times of inversion by the clocked inverter 151 and the inverter 152 in the odd-numbered stages, and outputted as the output signals of the unit circuits 144 of the even-numbered stages.

When the clock signal CLX falls to a low level (when the inverted clock signal CLXinv rises to a high level), the output terminals of the clocked inverters 151 in the odd-numbered stages becomes high impedance state. Therefore, the output signals of the inverters 152 are maintained at a logic level immediately before the clock signal CLX falls to a low level because of the latching by the inverters 152 and the clocked inverters 153. The maintained signals are provided to the input terminals of the unit circuits 144 of the even-numbered stages, and reverted by two times of logic inversion by the clocked inverters 151 and the inverters 152 of the even-numbered stages, and output as output signals of the unit circuits 144 of the even-numbered stages.

This operation is executed every time the logic level of the clock signal CLX (the inverted clock signal CLXinv) changes. Accordingly, the output signals of the unit circuits 144 in the first to $320^{th}$ stages shift every time the clock signal CLX is inverted.

Figure 6:
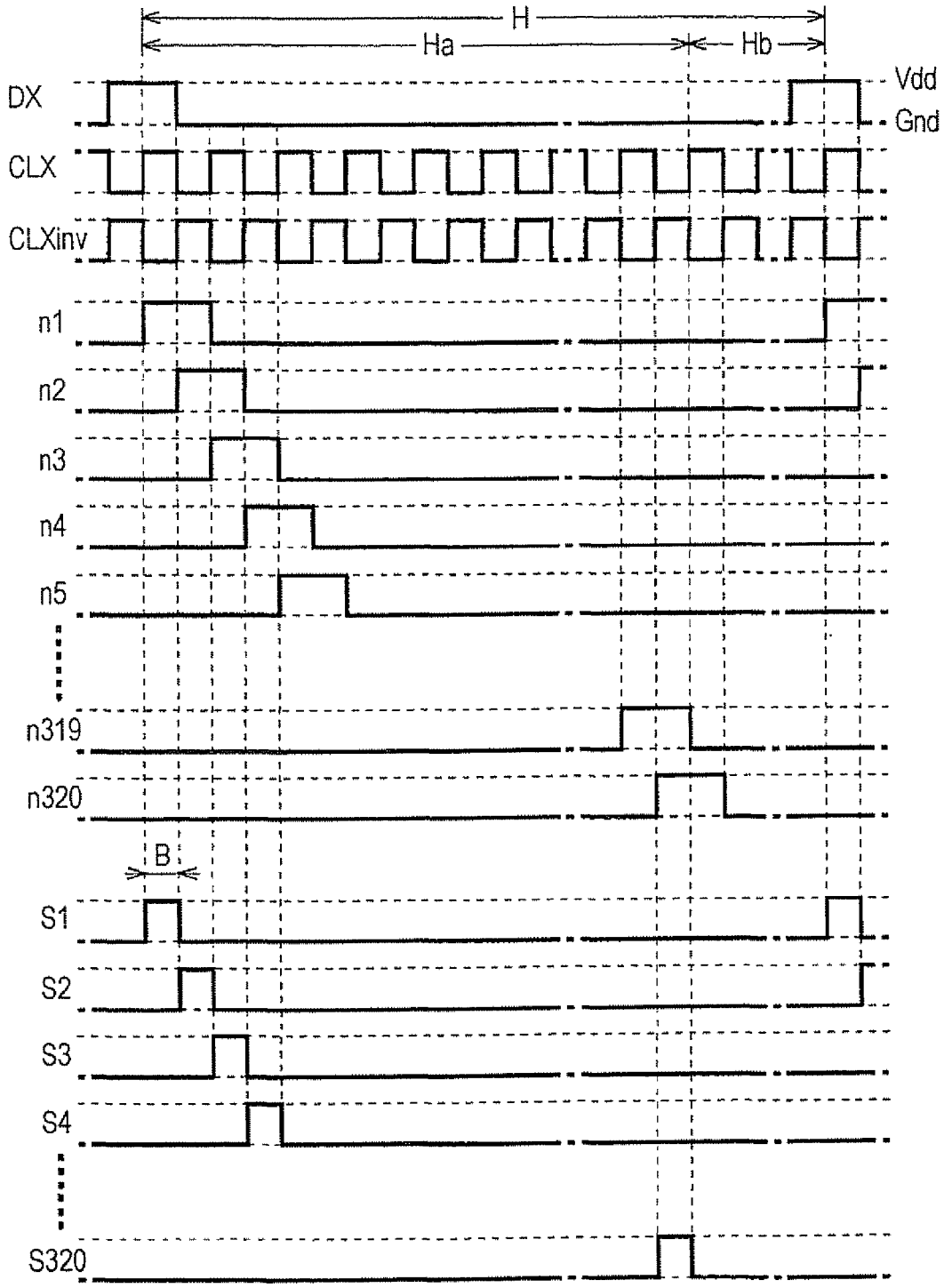
FIG. 6 is a timing chart showing the operation of the electrooptic device.

Accordingly, as shown in FIG. 6, when the duty ratio of the clock signal CLX and the inverted clock signal CLXinv is 50% and the start pulse DX with a pulse width corresponding to one cycle of the clock signal CLX is provided to the unit circuit 144 of the first stage at the trailing edge of the clock signal CLX, an output signal n1 forms a waveform delayed from the start pulse DX by half the cycle of the clock signal CLX. Similarly, output signals n2 to n320 are delayed in sequence every time the logic level of the clock signal CLX is inverted from the output signal n1, that is, every half cycle B of the clock signal CLX.

Therefore, as shown in FIG. 6, sampling signals S1 to S320 which are AND signals of the input signals and the output signals in the unit circuits 144 become pulse signals which rise exclusively to a high level in sequence every half cycle of the clock signal CLX.

Referring to FIG. 6, the period in which the sampling signals S1 to S320 rise to a high level in sequence is expressed as an effective horizontal-scanning period Ha. The control circuit 210 controls the scanning-line driving circuit 130 so that the horizontal scanning period H includes the effective horizontal-scanning period Ha. In FIG. 6, the period of the horizontal scanning period H other than the effective horizontal-scanning period Ha is expressed as a horizontal-scanning retrace period Hb.

Six image signal lines 170 are arranged in parallel along the X-direction between the block selecting circuit 142 and the sampling circuit 146. Since the data lines 114 are arranged along the Y-direction, the image signal lines 170 intersect the extensions of the data lines 114.

Six connecting signal lines 172 are provided in a one-to-one correspondence with the six image signal lines 170, and intersect an interconnect signal line 181 that connects the unit circuit 144 of the first stage and the unit circuit 144 of the second stage. Of the six connecting signal lines 172, the leftmost one in FIG. 2 is connected to the lowermost line of the six image signal lines 170. Similarly, the second to sixth connecting signal lines 172 from the left are connected to the second to sixth image signal lines 170 from below.

The six connecting signal lines 172 are provided with data signals R1, G1, B1, R2, G2, and B2 in order from the left, respectively, from the processing circuit 20. Accordingly, the six image signal lines 170 are also provided with the data signals R1, G1, B1, R2, G2, and B2 in order from below, respectively.

Accordingly, the colors of the data signals provided to the six image signal lines 170 and the colors of the pixels corresponding to the six data lines 114 in one block are the same RGBRGB in terms of the direction of arrangement although with a difference in direction, vertically and horizontally.

The sampling circuit 146 is configured by TFTs 148 provided for the first to 1,920th data lines 114, respectively. The TFTs 148 function as sampling switches, whose drain electrodes are each connected to one end of each data line 114.

The source electrode of each of the TFTs 148 is connected to one of the six image signal lines 170 in the relationship below. For generalization of explanation of the data lines 114, we use an integer j that satisfies $1 \leqq j \leqq 1{,}920$. The source electrode of the TFT 148 corresponding to the $j^{th}$ data line 114 from the left in FIG. 2 is connected to the image signal line 170 to which the data signal R1 is provided when the remainder of division of j, the number of the column) by 6 is 1. The source electrodes of the TFTs 148 corresponding to the data lines 114 in which the remainders of division of number j by 6 are 2, 3, 4, 5 and 0 are connected to the image signal lines 170 to which the data signals G1, B1, R2, G2, and B2 are provided, respectively. For example, the source electrode of the TFT 148 corresponding to the ninth data line 114 from the left is connected to the image signal line 170 to which the data signal B1 is provided because the remainder of division of 9 by 6 is 3.

The gate electrodes of the TFTs 148 in the same block are connected in common, to which the sampling signal of the unit circuit 144 corresponding to the block is provided. For example, the gate electrodes of the TFTs 148 corresponding to the six data lines 114 in the seventh to $12^{th}$ columns are provided with the same sampling signal S2 because the six data lines 114 correspond to the second block.

Here, when a sampling signal corresponding to a given block rises to a high level, six TFTs 148 in this block come into conduction between the source and drain electrodes, so that the data signals provided to the six image signal lines 170 are sampled to the six data lines 114 in this block.

The operation of the electrooptic device according to this embodiment will be described.

The image data Vd is provided from an upper-level system in order of, for dots, the first line and first column to the first line and $640^{th}$ column, the second line and first column to the second line and $640^{th}$ column, the third line and first column to the third line and $640^{th}$ column, - - - , the $480^{th}$ line and first column to the $480^{th}$ line and $640^{th}$ column. The image data Vd is provided dot by dot in synchronism with a dot clock signal Dclk, and phase-expanded to the image data Vd1*d* to Vd6*d* by the S/P converter circuit 220, as shown in FIG. 7.

Figure 7:
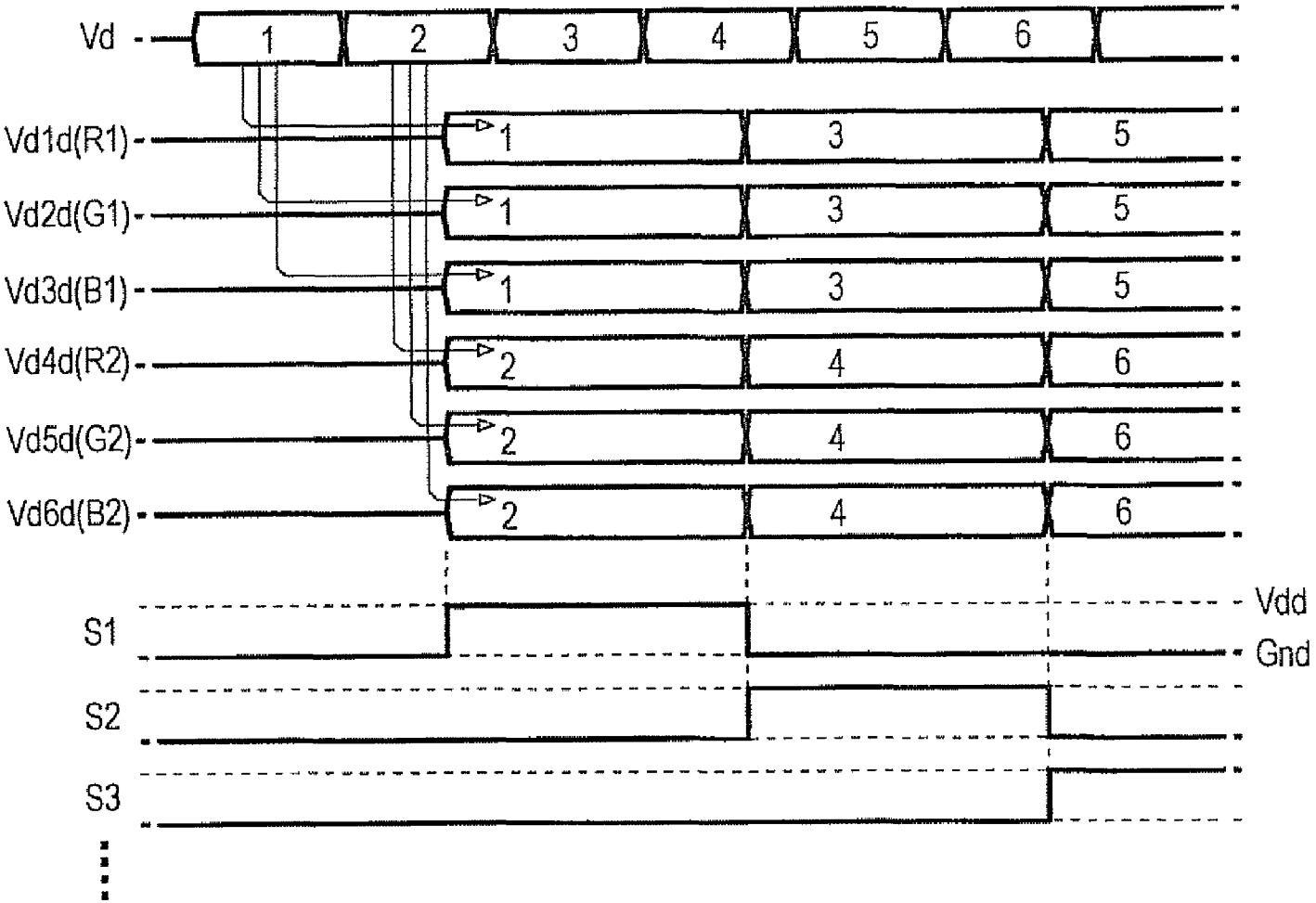
FIG. 7 is a timing chart showing the operation of the electrooptic device.

FIG. 7 shows the S/P converting process of the image data Vd corresponding to the dots on one line. Specifically, the image data Vd corresponding to the dots in the odd-numbered columns is distributed with delay into the image data Vd1*d* to Vd3*d* which designate the gray levels of R, G, and B, respectively, to be doubled along a time axis. The image data Vd corresponding to the dots in the even-numbered columns following the odd-numbered columns is distributed into the image data Vd4*d* to Vd6*d* which designate the gray levels of R, G, and B, respectively, to be doubled along a time axis.

The control circuit 210 outputs the start pulse DX and the clock signal CLX (the inverted clock signal CLXinv) so that the sampling signal S1 rises to a high level during the period in which the image data Vd1*d* to Vd6*d* corresponding to the dots in the first to second columns is output, and the sampling signal S2 rises to a high level during the period in which the image data Vd1*d* to Vd6*d* corresponding to the dots in the third to fourth columns is output, and likewise, sampling signals rise to a high level in sequence every time the image data Vd corresponding to the dots in the odd-numbered columns and the even-numbered columns following the odd-numbered columns is phase-expanded.

Specifically, the sampling signal S1 rises to a high level after the half cycle of the clock signal CLX from the time when the start pulse DX with a pulse width corresponding to one cycle of the clock signal CLX is provided at the trailing edge of the clock signal CLX. Hereafter, the sampling signals S2 to S320 rise to a high level while being delayed by half the cycle of the clock signal CLX. Accordingly, the control circuit 210 raises the level of the start pulse DX to a high level at the timing prior to the timing when the image data Vd1*d* to Vd6*d* corresponding to the dots in the first and second columns is output, and inverts the logic of the clock signal CLX (the inverted clock signal CLXinv) every time the image data Vd corresponding to dots in the odd-numbered columns and the even-numbered columns following the odd-numbered columns is phase-expanded by the S/P converter circuit 220, and outputs it.

The data signal provided to the liquid crystal element 120 is designated positive polarity and negative polarity, as described above. This embodiment employs line inversion in which the written polarity is inverted every line and the same line is alternately changed between positive polarity and negative polarity every vertical scanning period F. Here, positive polarity is written to the odd-numbered lines during the vertical scanning period F.

First, the first scanning line 112 is selected in the vertical scanning period F, and the scanning signal Y1 rises to a high level. When the scanning signal Y1 rises to a high level, the pixels 110 on the first line, that is, the TFTs 116 from the first line and first column to the first line and $1{,}920^{th}$ column are turned on.

The control circuit 210 phase-expands the image data Vd of the dots in the first line and first column and in the first line and second column, and outputs the start pulse DX, the clock signal CLX (the inverted clock signal CLXinv) so that the sampling signal S1 rises to a high level in accordance with the phase-expansion, as described above.

Here, the data signal R1 which is provided to the image signal line 170 through the connecting signal line 172 when the sampling signal S1 rises to a high level is a signal of the red image data Vd1*d* of the dot in the first line and first column converted to positive polarity. The data signals G1 and B1 provided to the image signal lines 170 are signals of the green image data Vd2*d* and the blue image data Vd3*d* of the dot in the first line and first column converted to positive polarity, respectively. Likewise, the data signals R2, G2, and B2 provided to the image signal lines 170 are signals of the red image data Vd4*d*, the green image data Vd5*d*, and the blue image data Vd6*d* of the dot in the first line and second column converted to positive polarity, respectively.

When the sampling signal S1 rises to a high level, the TFTs 148 in the first to sixth columns of the first block are turned on. Therefore, the data signals R1, G1, B1, R2, G2, and B2 provided to the six image signal lines 170 are sampled to the data lines 114 corresponding to the first to sixth columns, so that the pixel electrodes 118 from the first line and first column to the first line and sixth column are respectively provided with positive voltages corresponding to the gray levels of the colors via the TFTs 116 in ON state.

Next, the sampling signal S2 rises to a high level. The data signals R1, G1, and B1 applied to the image signal lines 170 through the connecting signal lines 172 when the sampling signal S2 rises to a high level are signals of the red image data Vd1*d*, green image data Vd2*d*, and blue image data Vd3*d* of the dot in the first line and third column converted to positive polarity. Likewise, the data signals R2, G2, and B2 are signals of the red image data Vd4*d*, green image data Vd5*d*, and blue image data Vd6*d* of the dot in the first line and fourth column converted to positive polarity.

When the sampling signal S2 rises to a high level, the TFTs 148 from the seventh to $12^{th}$ columns of the second block are turned on. Therefore, the data signals R1, G1, B1, R2, G2, and B2 provided to the six image signal lines 170 are sampled to the data lines 114 corresponding to the seventh to $12^{th}$ columns, so that the pixel electrodes 118 from the first line and seventh column to the first line and $12^{th}$ column are provided with positive voltages corresponding to the gray levels of the respective colors through the TFTs 116 in ON state, respectively.

The above operation is repeated until the sampling signal S320 rises to a high level, and thus, the pixel electrodes 118 from the first line and first column to the first line and $1{,}920^{th}$ column are provided with positive voltages corresponding to the gray levels of the respective colors. Thereafter, the second scanning line 112 is selected after the horizontal-scanning retrace period Hb, and the scanning signal Y2 rises to a high level. When the scanning signal Y2 rises to a high level, the scanning signal Y1 falls to a low level, so that the TFTs 116 from the first line and first column to the first line and 1,920 column are turned off, while the voltage applied to the pixel electrodes 118 in the ON state is held in the capacity of the liquid crystal element 120.

When the second scanning line 112 is selected, the TFTs 116 from the second line and first column to the second line and $1{,}920^{th}$ column are turned on as when the first scanning line 112 is selected, so that the sampling signals S1 to S320 rise to a high level in sequence. However, the polarity of the data signals R1, G1, B1, R2, G2, and B2 is inverted into negative polarity, so that the pixel electrodes 118 from the second line and first column to the second line and $1{,}920^{th}$ column are provided with negative voltages corresponding to the respective colors.

The above operation is repeated for the third to $480^{th}$ lines. Thus, the pixel electrodes 118 in the odd-numbered lines are provided with positive voltages corresponding to the gray levels of the respective colors, while the pixel electrodes in the even-numbered lines 118 are provided with negative voltages corresponding to the gray levels of the respective colors.

The above operation is repeated also in the following vertical scanning period. However, since the polarity is inverted, the pixel electrodes 118 in the odd-numbered lines are provided with negative voltages corresponding to the gray levels of the respective colors, while the pixel electrodes 118 in the even-numbered lines are provided with positive voltages corresponding to the gray levels of the respective colors.

FIG. 8 is a diagram showing one example of the voltage waveform of, for example, the data signal R1 during the horizontal scanning periods H in which the $i^{th}$ scanning line 112 and the $(i+1)^{th}$ scanning line 112 are selected, respectively.

In this diagram, voltages Vb(+) and Vb(−) are positive and negative voltages corresponding to black with the lowest gray level, respectively, and are symmetrical about a reference voltage Vc.

Here, assume that the image data Vd designates the gray levels of the R, G, and B, for example, with 8 bits, and when the gray level is 0 in decimal notation, designates the darkest gray level, and as the decimal digit increases, designates a lighter gray level, and when the decimal digit is 255, designates the lightest gray level. In this case, since this embodiment assumes a normally black mode, the voltage of the data signal R1, in conversion to positive polarity, becomes higher than the voltage Vb(+) as the gray level increases, and in conversion to negative polarity, becomes lower than the voltage Vb(−).

The voltage LCcom to be applied to the common electrode 108 is set lower than the reference voltage Vc, as shown in FIG. 8. This is because pushdown occurs in the n-channel TFT 116 in which the potential of the drain (the pixel electrode 118) decreases when changing from ON to OFF because of the parasitic capacitance between the gate and drain electrodes. If the voltage LCcom is equated with the reference voltage Vc, the effective voltage of the liquid crystal element 120 by negative writing becomes slightly higher than that by positive writing because of the pushdown (for the n-channel TFT 116). Therefore, the voltage LCcom is set lower than the reference voltage Vc so that the influence of the pushdown is offset. However, the voltage LCcom and the reference voltage Vc may be equalized provided that the influence of the pushdown is negligible.

In the case where positive polarity is designated to the liquid crystal element 120 on the $i^{th}$ line, when the sampling signal S1 rises to a high level during the horizontal scanning period H in which the scanning signal Yi rises to a high level, the voltage of the data signal R1 becomes a positive voltage corresponding to the gray level of the red pixel in the $i^{th}$ line and first column, and then changes to positive voltages corresponding to the gray levels of the red pixels in the seventh to $1{,}915^{th}$ columns as the sampling signal S1 changes.

For the following $(i+1)^{th}$ line, the polarity is inverted to negative polarity. Accordingly, when the sampling signal S1 rises to a high level during the horizontal scanning period H in which the scanning signal Y(i+1) rises to a high level, the voltage of the data signal R1 becomes a negative voltage corresponding to the gray level of the red pixel in the (i+1) th line and first column, and thereafter changes to negative voltages corresponding to the gray levels of the red pixels in the seventh to $1{,}915^{th}$ columns as the sampling signal S1 changes.

The vertical scale in FIG. 8 indicative of the voltage of the data signal R1 is magnified, for convenience, as compared with that of the other signals. The voltage is set to a voltage corresponding to black during the horizontal-scanning retrace period Hb in which the sampling signal S1 changes to a high level after the sampling signal S320 falls to a low level. This is for the purpose of preventing erroneously data writing to pixels due to timing shift from affecting the display.

While FIG. 8 shows the voltage waveform of the data signal R1 by way of example, the other data signals G1, B1, R2, G2, and B2 are also converted to voltages according to the gray levels.

Figure 14:
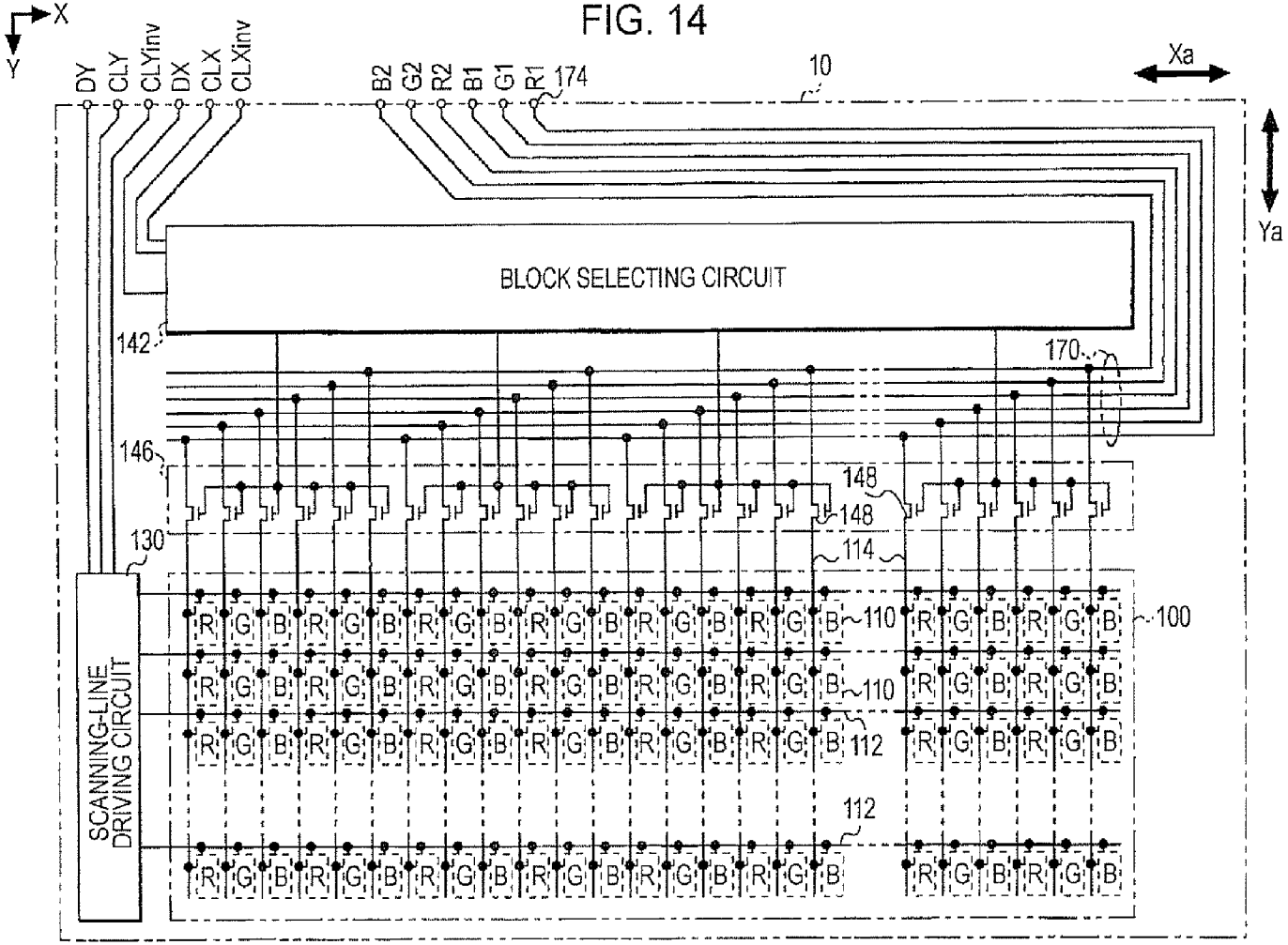
Prior Art FIG. 14
FIG. 14, a schematic plan view of a display panel of a related art.

In this embodiment, the six image signal lines 170 are connected respectively to the connecting terminals 174 through the six connecting signal lines 172 passing between the unit circuits 144 in the first and second stages. As shown in FIG. 14, a related-art structure in which the six image signal lines 170 are connected directly to connecting terminals 174 provided on the side of the device substrate along the X-direction needs to wire the image signal lines 170 around the block selecting circuit 142.

Therefore, the substrate needs an additional space corresponding to the rounding portions Xa and Xb of the image signal lines 170, which becomes a cause of hindering the reduction of the substrate to reduce cost and narrowing the frame to increase the flexibility of packaging. Particularly, although this structure employs six times of phase expansions in the S/P conversion, the portions Xa and Xb increase with an increasing number of phase expansions, such as 12, 24, . . . , 96, which needs a wide substrate space, thus posing a negligible problem.

In contrast, this embodiment has a structure in which the image signal lines 170 are connected respectively to the connecting terminals 174, without rounding, through the connecting signal lines 172 passing between the unit circuits 144. This eliminates the need for the space for the portions Xa and Xb, allowing the reduction of the substrate and the narrowing of the frame.

When the connecting signal lines 172 are routed from the connecting terminals 174 to the image signal lines 170 while being passed between the unit circuits 144, as in this embodiment, the connecting signal lines 172 intersect the interconnect signal line 181 connecting the output terminal of the unit circuit 144 in the first stage and the input terminal of the unit circuit 144 in the second stage, the signal line for feeding the clock signal CLX, and the signal line for feeding the inverted clock signal CLXinv. Therefore, the noise due to those signal lines seems to be propagated to the analog data signals R1, G1, B1, R2, G2, and B2 applied to the connecting signal lines 172 to fluctuate the voltage sampled to the data lines 114, thus affecting the display.

Figure 9:
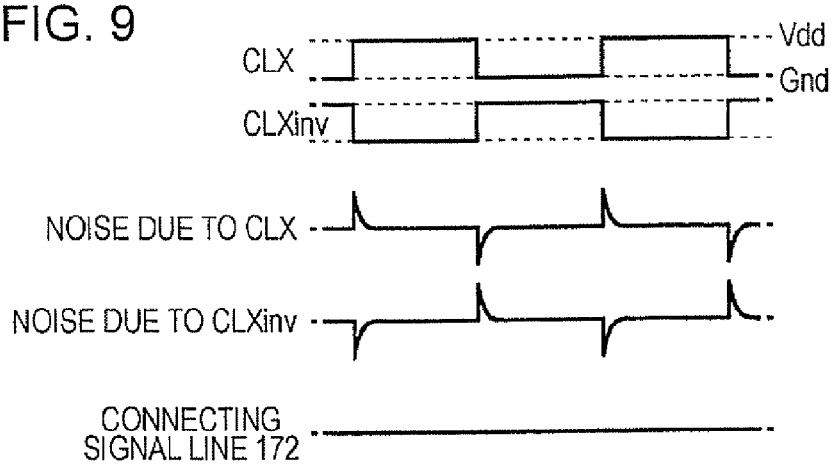
FIG. 9 is a diagram showing the influence of clock signals and so on in the electrooptic device.
Figure 10:
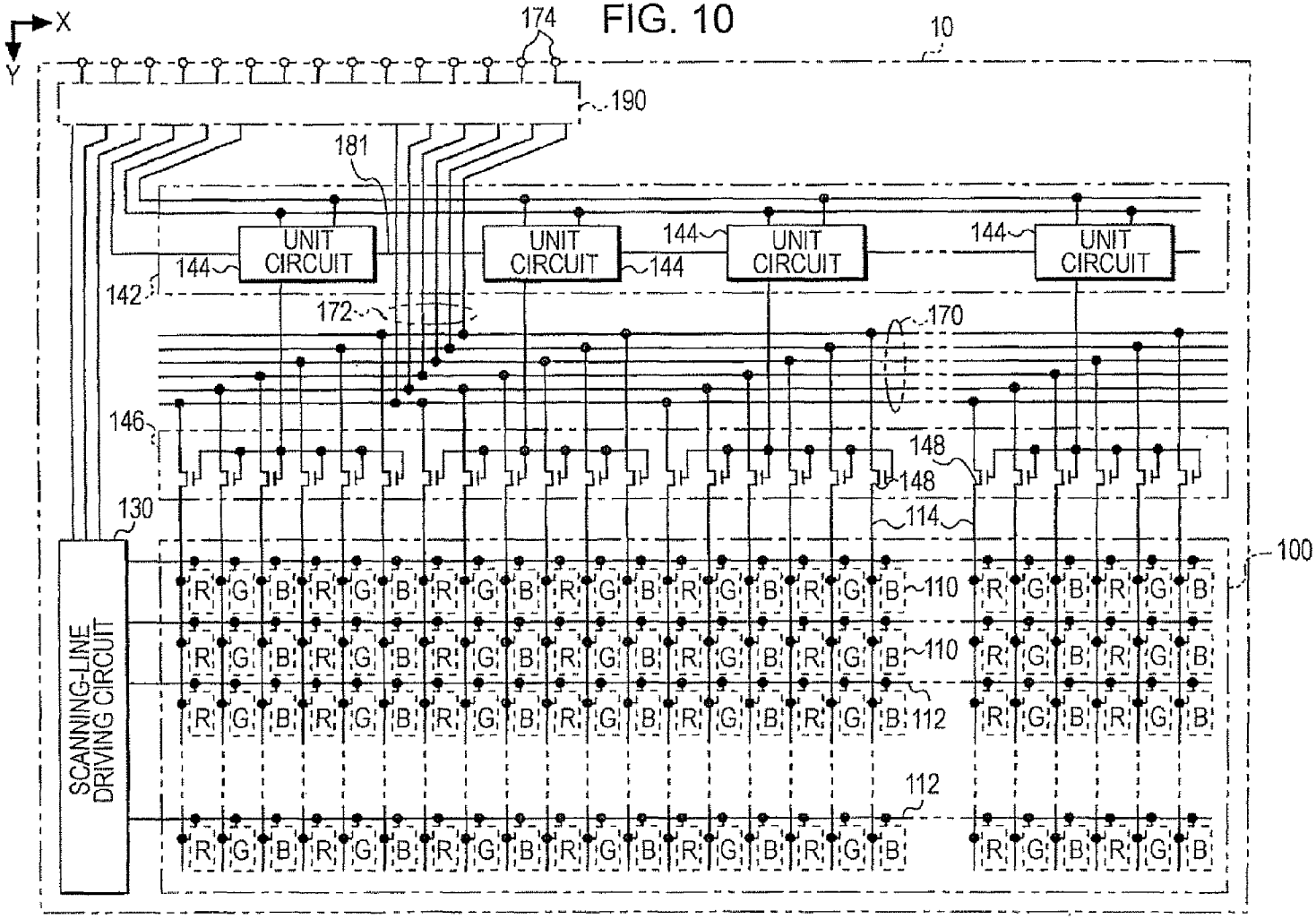
FIG. 10 is a schematic plan view of a display panel according to a modification of the electrooptic device.

However, since the clock signal CLX is inverted in logic into the inverted clock signal CLXinv, the noise that is generated when the logic level of the clock signal CLX changes and the noise that is generated when the logic level of the inverted clock signal CLXinv changes are offset because they are opposite and have the same loudness level, as shown in FIG. 9. Accordingly, in this embodiment, most of the influence of the noise due to the intersections of the connecting signal lines 172 and the signal line for feeding the clock signal CLX and the signal line for feeding the inverted clock signal CLXinv may be negligible.

Furthermore, in this embodiment, the signal provided to the interconnect signal line 181 is the signal n1 output from the unit circuit 144 in the first stage, which changes only from low→high→low at a time during the horizontal scanning period H. Therefore, the influence of the noise due to the intersection of the connecting signal lines 172 and the interconnect signal line 181 may be almost negligible.

While this embodiment is configured such that the display panel 10 and the processing circuit 20 are connected with an FPC substrate, an IC chip that implements part or all of the function of the processing circuit 20 may be mounted on a device substrate area 190 using a chip-on-glass technique or the like.

This embodiment is configured such that the connecting signal lines 172 pass between the unit circuits 144 in the first and second stages. However, if the delay of the data signals applied to the image signal lines 170 is different between the left and right ends, it is preferable that the connecting signal lines 172 pass between, for example, the unit circuits 144 in the $160^{th}$ and $161^{st}$ stages to be connected to almost the center of the image signal lines 170.

An electrooptic device according to a second embodiment of the invention will be described. The difference between the second embodiment and the first embodiment is the connecting signal lines 172 of the display panel 10. Since the others are the same as those of the first embodiment, descriptions thereof will be omitted.

Figure 11:
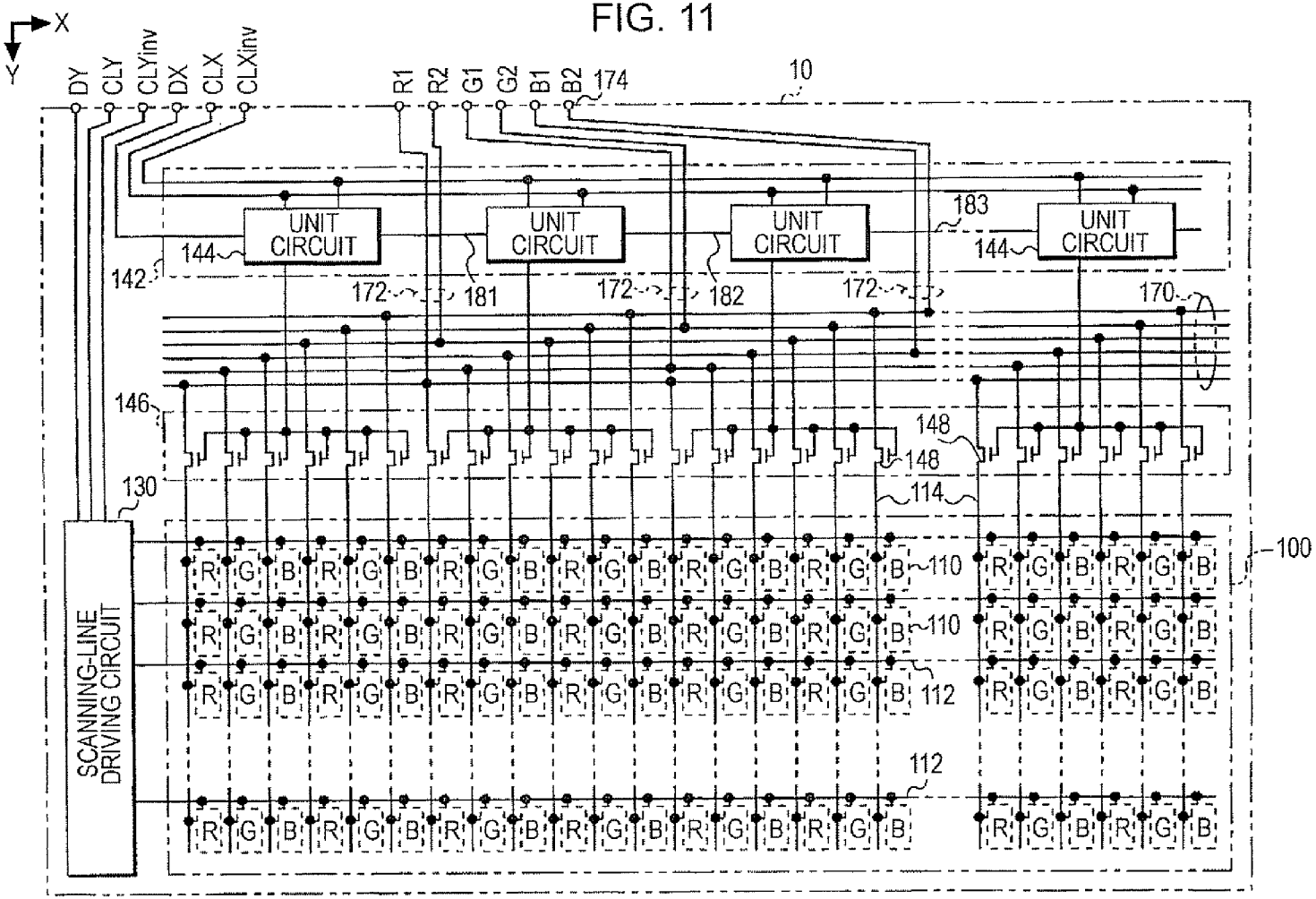
FIG. 11 is a schematic plan view of a display panel according to a second embodiment of the invention.

FIG. 11 is a plan view of the display panel 10 according to the second embodiment.

As shown in this diagram, the second embodiment is configured such that the connecting signal lines 172 are divided by colors of RGB, and the connecting signal lines 172 of the same color are connected from the connecting terminals 174 to the image signal lines 170 while being passed between the same unit circuits 144.

Specifically, in this embodiment, the number of data lines that constitute one block is six. Therefore, two connecting signal lines 172 for red intersect the interconnect signal line 181 that connects the unit circuits 144 of the first and second stages; two connecting signal lines 172 for green intersect the interconnect signal line 182 that connects the unit circuits 144 of the second and third stages; and two connecting signal lines 172 for blue intersect the interconnect signal line 183 that connects the unit circuits 144 of the third and fourth stages.

This second embodiment allows the substrate space to be reduced and the frame to be narrowed, and makes the time constants of the connecting signal lines 172 of the same color closer to each other than that of the first embodiment. This prevents the voltages of data signals applied to the image signal lines 170 from becoming uneven due to variations in the time constant of the connecting signal lines 172, thereby preventing vertical unevenness of display.

The second embodiment may be configured such that connecting signal lines 172 of different colors, for example, four connecting signal lines 172 for red and green may be let pass between the same unit circuits 144, and two connecting signal lines 172 for blue may be let pass between the other unit circuits 144.

An electrooptic device according to a third embodiment of the invention will be described. The difference between the third embodiment and the first embodiment is the order of the connecting signal lines 172 and the image signal lines 170 of the display panel 10. Since the others are the same as those of the first embodiment, descriptions thereof will be omitted.

Figure 12:
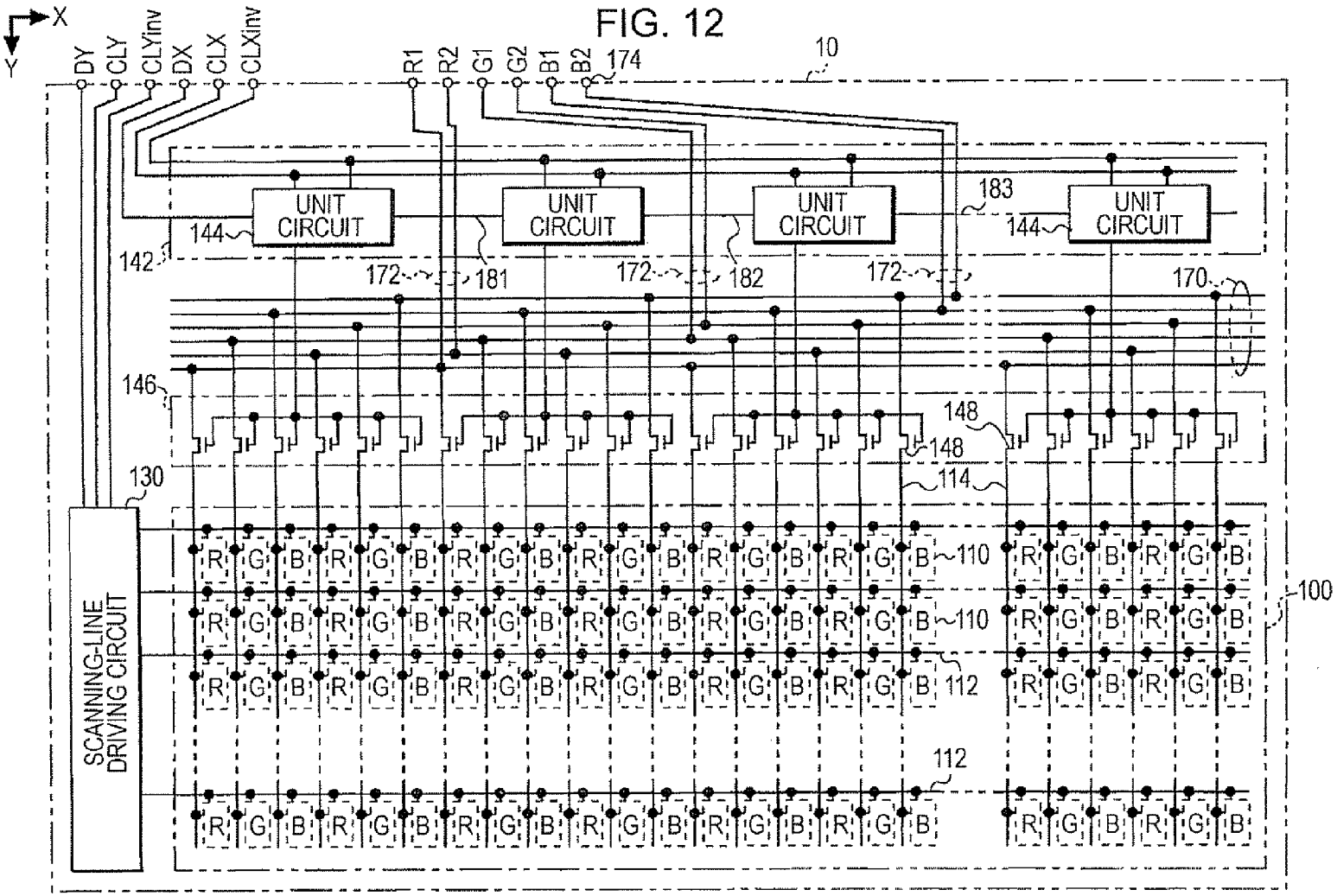
FIG. 12 is a schematic plan view of a display panel according to a third embodiment of the invention.

FIG. 12 is a plan view of the display panel 10 according to the third embodiment.

As shown in this diagram, the third embodiment is the same as the second embodiment in that the connecting signal lines 172 are divided by colors of RGB, and the connecting signal lines 172 of the same color are connected from the connecting terminals 174 to the image signal lines 170 while being passed between the same unit circuits 144, but is different from the second embodiment in that the data signals applied to the image signal lines 170 are grouped by two of the same color in order of R1, R2, G1, G2, B1, and B2 from below.

This third embodiment allows the substrate space to be reduced and the frame to be narrowed, and makes the time constants of not only the connecting signal lines 172 of the same color but also the time constants of the image signal lines 170 close to each other. This prevents vertical unevenness of display more effectively.

Although the above embodiments set the number of phase expansions in the S/P converter circuit 220 to six, it may be increased, such as 9, 12, 15 and so on, or alternatively, set to three without phase expansion. Furthermore, the above embodiments express one dot by the three colors RGB, one dot may be expressed by four or more colors with additional emerald green Eg.

Here, the number m of phase expansions should be a multiple of n when the number of colors for expressing one dot is n that is greater than or equal to 3.

In the above embodiments, the block selecting circuit 142 transfers the start pulse DX only to the right in FIG. 2. Alternatively, the start pulse DX may be transferred both to the right and left using a transfer-direction control signal DIR or the like.

In the above embodiments, the liquid crystal element 120 is described as a normally black mode. Alternatively, it may be a normally white mode in which the liquid crystal element 120 displays in white under application of no voltage. Furthermore, it may not necessarily be of a transmissive type, but may be of a reflection type or an intermediate semitransmissive semireflective type.

In addition, this invention can be applied to all configurations in which analog data signals are applied to the image signal lines 170. Therefore, this invention can be applied not only to those using a liquid crystal element but also those using an electronic luminescence (EL) element, an electron emissive element, or an electrophoretic element.

Electronic Apparatus

An example of an electronic apparatus incorporating the electrooptic device 1 according to the above embodiments as a display device will be described.

Figure 13:
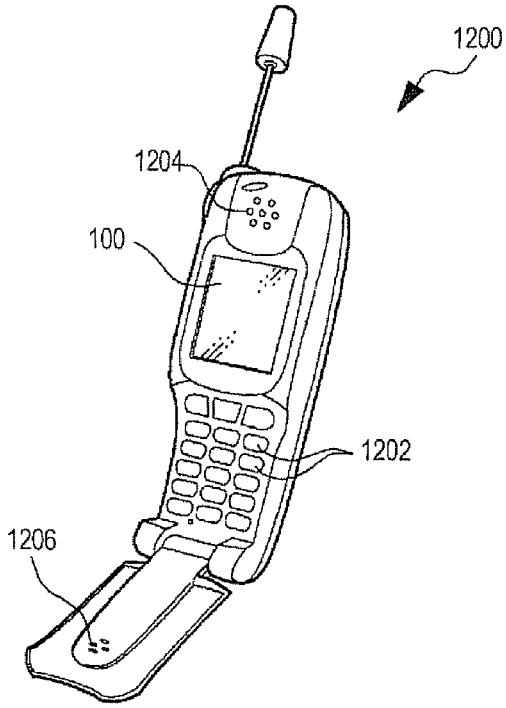
FIG. 13 is a diagram showing the structure of a portable phone incorporating the electrooptic device.

FIG. 13 is a diagram of a portable phone 1200 incorporating the electrooptic device 1 of an embodiment. As shown in the diagram, the portable phone 1200 includes a plurality of operation buttons 1202, an ear piece 1204, a mouthpiece 1206, and the electrooptic device 1 described above.

Examples of electronic apparatuses incorporating the electrooptic device 1 include, in addition to the portable phone 1200 shown in FIG. 13, digital still cameras, notebook computers, liquid crystal televisions, video recorders, car navigation systems, pagers, electronic notebooks, calculators, word processors, workstations, TV phones, POS terminals, and touch panels. Obviously, the electrooptic device 1 can be used as the displays of such various electronic apparatuses.

What is claimed is:

1. An electrooptic device comprising:

a plurality of scanning lines;

a plurality of m image signal lines;

m connecting signal lines provided in a one-to-one correspondence with the m image signal lines, each connecting signal line being connected to the corresponding image signal line to feed a data signal;

a plurality of data lines blocked by m lines, m data lines in one block being provided in a one-to-one correspondence with the m image signal lines;

a scanning-line driving circuit that selects the plurality of scanning lines in a predetermined order;

a block selecting circuit that outputs sampling signals indicative of the selection of the blocks in a predetermined order during a period selected for one scanning line;

a sampling switch provided for each of the plurality of data lines, each sampling switch being turned on between the corresponding image signal line and data line when the sampling signal selects a block; and pixels provided at the intersections of the plurality of scanning lines and the plurality of data lines, each pixel becoming a gray level corresponding to the data signal sampled to the data line when the scanning line is selected;

wherein:

the block selecting circuit has a plurality of unit circuits whose output terminals are each connected to the input terminal of the following stage, the unit circuits each outputting a pulse provided to the input terminal from the output terminal with a predetermined delay and outputting a sampling signal according to the pulse provided to the input terminal and the output terminal; and the connecting signal lines intersect an interconnect signal line connecting the output terminal of one unit circuit and the input terminal of the unit circuit in the following stage.

2. The electrooptic device according to claim 1, wherein:

the m image signal lines are provided in the direction intersecting the extensions of the plurality of data lines; and the direction of the arrangement of the unit circuits agrees with the direction in which the m image signal lines are provided.

3. The electrooptic device according to claim 1, wherein the m connecting signal lines intersect one interconnect signal line.

4. The electrooptic device according to claim 1, wherein:

the pixels are in one of n colors (n is an integer greater than or equal to 3);

the m is a multiple of n;

m data lines in one block are arranged such that data lines corresponding to pixels of the n colors are arranged repeatedly in a predetermined order;

the m image signal lines are arranged repeatedly in the same order as the colors of the m data lines; and m/n connecting signal lines connected to image signal lines corresponding to one color intersect at least one interconnect signal line.

5. The electrooptic device according to claim 1, wherein:

the pixels are in one of n colors (n is an integer greater than or equal to 3);

the m is a multiple of n;

m data lines in one block are arranged such that data lines corresponding to pixels of the n colors are arranged repeatedly in a predetermined order;

the m image signal lines are arranged in the group of m/n lines in the same order as the colors of the m data lines; and m/n connecting signal lines connected to image signal lines corresponding to one color intersect one interconnect signal line.

6. An electronic apparatus comprising the electrooptic device according to claim 1.

* * * * *